US008770116B2

(12) United States Patent
Heim et al.

(10) Patent No.: US 8,770,116 B2
(45) **Date of Patent: *Jul. 8, 2014**

(54) SYSTEM, METHOD AND APPARATUS FOR SECURING VALUABLES

(71) Applicants: Jeffrey R. Heim, St. Petersburg, FL (US); Richard Allen Angwin, Spring Hill, FL (US)

(72) Inventors: Jeffrey R. Heim, St. Petersburg, FL (US); Richard Allen Angwin, Spring Hill, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/970,792

(22) Filed: Aug. 20, 2013

(65) Prior Publication Data

US 2013/0340657 A1 Dec. 26, 2013

Related U.S. Application Data

(63) Continuation of application No. 13/670,568, filed on Nov. 7, 2012, now Pat. No. 8,534,206, which is a continuation of application No. 13/472,590, filed on May 16, 2012, now Pat. No. 8,327,777, which is a continuation of application No. 12/652,453, filed on Jan. 5, 2010, now Pat. No. 8,201,426.

(51) Int. Cl.
*E05G 1/00* (2006.01)

(52) U.S. Cl.
USPC ..... 109/50; 109/45; 109/48; 70/63; 206/1.5; 224/912

(58) Field of Classification Search
CPC ..... E05B 65/0075; E05G 1/00; E05G 1/005; E05G 1/04; E05G 1/10; E05G 2700/00; E05G 2700/02; F41C 33/06; B60K 15/05; B60K 15/0409; B65D 55/14; B60R 7/04; A47C 21/00; G06F 7/04
USPC ..... 109/45, 48, 50–52, 54; 70/63, 159–162; 206/1.5; 224/912
See application file for complete search history.

(56) References Cited

U.S. PATENT DOCUMENTS

| | | | | |
|---|---|---|---|---|
| 1,423,804 | A | 7/1922 | Kontrowitz | |
| 1,924,365 | A | 8/1933 | Mariotti | |
| 2,643,397 | A | 6/1953 | Ehrenreich | |
| 3,464,606 | A | 9/1969 | Nordeen | |
| 3,468,576 | A * | 9/1969 | Beyer et al. | 292/251.5 |
| 4,276,667 | A | 7/1981 | Osbourne | |
| 4,483,501 | A | 11/1984 | Eddy | |
| 4,570,888 | A | 2/1986 | Evans | |
| 4,691,396 | A | 9/1987 | Hoffman | |
| 4,716,632 | A | 1/1988 | Perl | |
| 4,768,021 | A | 8/1988 | Ferraro | |
| 4,788,838 | A | 12/1988 | Cislo | |
| 4,800,822 | A * | 1/1989 | Adkins | 109/19 |

(Continued)

*Primary Examiner* — Suzanne Barrett
(74) *Attorney, Agent, or Firm* — Larson & Larson, P.A; Frank Liebenow; Justin P. Miller

(57) ABSTRACT

A safe includes a body that has an opening for receiving and holding an object. A door is rotatably interfaced to the body, whereas the door obstructs the opening in a first position of rotation, and the door provides access to the body of the safe through the opening when the door is in a second position of rotation. A locking mechanism engages between the door and the body when the door is rotated to the first position of rotation thereby holding the door in the first position of rotation until the locking mechanism is released and, upon releasing by the locking mechanism, the door is free to rotate towards the second position of rotation.

20 Claims, 5 Drawing Sheets

(56) References Cited

U.S. PATENT DOCUMENTS

| | | | | |
|---|---|---|---|---|
| 4,807,315 | A | 2/1989 | Wachenheim | |
| 4,869,449 | A | 9/1989 | Goodman | |
| 4,890,466 | A | 1/1990 | Cislo | |
| 5,009,088 | A | 4/1991 | Cislo | |
| 5,056,342 | A | 10/1991 | Prinz | |
| 5,111,545 | A | 5/1992 | Krozal | |
| 5,111,755 | A | 5/1992 | Rouse | |
| 5,172,575 | A | 12/1992 | Fisher | |
| 5,317,888 | A | 6/1994 | Towns | |
| 5,732,914 | A | 3/1998 | Flinn | |
| 5,901,589 | A | 5/1999 | Cordero | |
| 5,916,087 | A | 6/1999 | Owens | |
| 5,987,941 | A | 11/1999 | Zocco | |
| 6,260,300 | B1 | 7/2001 | Klebes | |
| 6,318,134 | B1 | 11/2001 | Mossberg et al. | |
| 6,523,374 | B1 | 2/2003 | Owens | |
| 6,843,081 | B1 | 1/2005 | Painter | |
| 7,299,667 | B1 | 11/2007 | Miresmaili | |
| 7,434,427 | B1 | 10/2008 | Miresmaili | |
| 7,546,920 | B1 | 6/2009 | Horn et al. | |
| 8,074,477 | B1 | 12/2011 | Weiche | |
| 8,104,313 | B2 | 1/2012 | Wolfe | |
| 8,186,188 | B1 | 5/2012 | Brown | |
| 8,201,426 | B2 | 6/2012 | Heim et al. | |
| 8,327,777 | B2 | 12/2012 | Heim et al. | |
| 8,484,809 | B2 * | 7/2013 | Fiedler | 24/303 |
| 2003/0037506 | A1 | 2/2003 | Seibert | |
| 2006/0112741 | A1 | 6/2006 | Engel | |
| 2007/0138806 | A1 * | 6/2007 | Ligtenberg et al. | 292/251.5 |

* cited by examiner

SYSTEM, METHOD AND APPARATUS FOR SECURING VALUABLES

CROSS-REFERENCE TO RELATED APPLICATION

This application is a continuation of U.S. patent application Ser. No. 13/670,568, filed Nov. 7, 2012, which is a continuation of U.S. Pat. No. 8,327,777, issued Dec. 11, 2012, which is a continuation of U.S. Pat. No. 8,201,426, issued Jun. 19, 2012, the disclosures of both are hereby incorporated by reference.

FIELD

This invention relates to the field of security and more particularly to a system, method and apparatus for securing valuables such as guns to a bed.

BACKGROUND

It is well known in the art to provide secure storage for valuables such as jewelry, guns, currency, and the like. Lock boxes, safes, gun safes, etc, are well known for such purposes. Often, these safes or lock boxes or locked cabinets have key locks, combination locks and/or biometric locks (e.g. fingerprint readers). Depending upon the security level required, such devices are sometimes made out of very heavy, thick steel, reducing the risk of unauthorized access to the contents while, due to the weight, reducing the risk of the entire device being removed. Also, or in addition, sometimes these devices are hidden and/or secured in place. For example, it is well known to screw a safe into a wall, and then hide the safe behind a painting or other ornament.

In general, these devices have several features in common. They have a box-like construction, sealed on five sides; they have a door that is connected to the box-like portion by hinges and they have a locking device that prevents the door from opening without the proper access key (physical key, password, biometric match, combination, etc).

Several problems exist in the prior art. Depending upon the thickness of the safe/box and door and the gap between the door and the box, it is possible to pry open some such devices by inserting a lever between the box and the door, Another problem in some installations is that there isn't enough room for a door to swing open such as when the safe is attached to a bed frame between the bed and furniture or bed and wall. In some situations, quick and ready access to the contents of the safe are required such as when an intruder alarm sounds when the occupant sleeps. In some situations, due to the size and low weight of the safe, it is desired to attach the safe to a larger, heavier object. Many of these problems are not addressed in the prior art as well as other limitations that will be obvious in the following description.

What is needed is a system, method, and apparatus for securing valuables, and in particular, for securing weapons.

SUMMARY

A safe or strong box attachment mechanism is disclosed. The safe (or strong box) has a rotatable door that, when a proper code/combination/biometric is provided, rotatably opens to expose the contents. The safe/strong-box optionally attaches to a bed system by a plate that has barbs. The barbed plate readily inserts between a box spring and a mattress, but due to the barbs, is difficult to remove without lifting the mattress from the box spring making it at least difficult to remove by, for example, children in the home.

In one embodiment, a safe is disclosed having a safe body that has an opening. A door is rotatably interfaced to the safe body such that the door obstructs the opening in a first position of rotation and the door provides access to the safe through the opening in a second position of rotation, whereas the door rotates to be at least partially contained within the safe body in the second position of rotation. An energy storage mechanism is interfaced between the safe body and the door and a locking mechanism affixed to the safe body. The locking mechanism engages between the door and the safe body when the door is in the first position of rotation. Energy is stored in the energy storing mechanism when the door is rotated into the first position of rotation and, upon enabling access by the locking mechanism, the locking mechanism disengages between the door from the safe body, and the energy storing mechanism releases the energy causing the door to rotate into the second position of rotation.

In another embodiment, a method of providing quick access to a protected weapon is disclosed. The method includes providing a safe that has a body portion with an opening and a door rotatably interfaced to the body portion. The door is shaped as a partial cylinder such that the door restricts access to the opening in a first position of rotation and the door provides access to the safe through the opening in a second position of rotation. A locking mechanism is interfaced between the body portion and the door. The locking mechanism engages the door and the body portion when the door is in the first position of rotation and, upon enabling access by the locking mechanism; the locking mechanism disengages with the door, allowing the door to rotate into the second position of rotation. An energy storing mechanism is interfaced between the door and the body portion. The method continues with placing a weapon within the body portion of the safe and closing and locking the door, thereby storing energy in the energy storing mechanism. At some time, providing a key to the locking system, at which time the locking system releases the locking mechanism responsive to the key and the energy storing mechanism rotates the door to the second position responsive to the releasing of the locking mechanism, thereby providing access to the weapon.

In another embodiment, a safe is disclosed including a body that has an opening for receiving and holding an object. A door is rotatably interfaced to the body, whereas the door obstructs the opening in a first position of rotation, and the door provides access to the body of the safe through the opening when the door is in a second position of rotation. A locking mechanism engages between the door and the body when the door is rotated to the first position of rotation thereby holding the door in the first position of rotation until the locking mechanism is released and, upon releasing by the locking mechanism, the door is free to rotate towards the second position of rotation.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
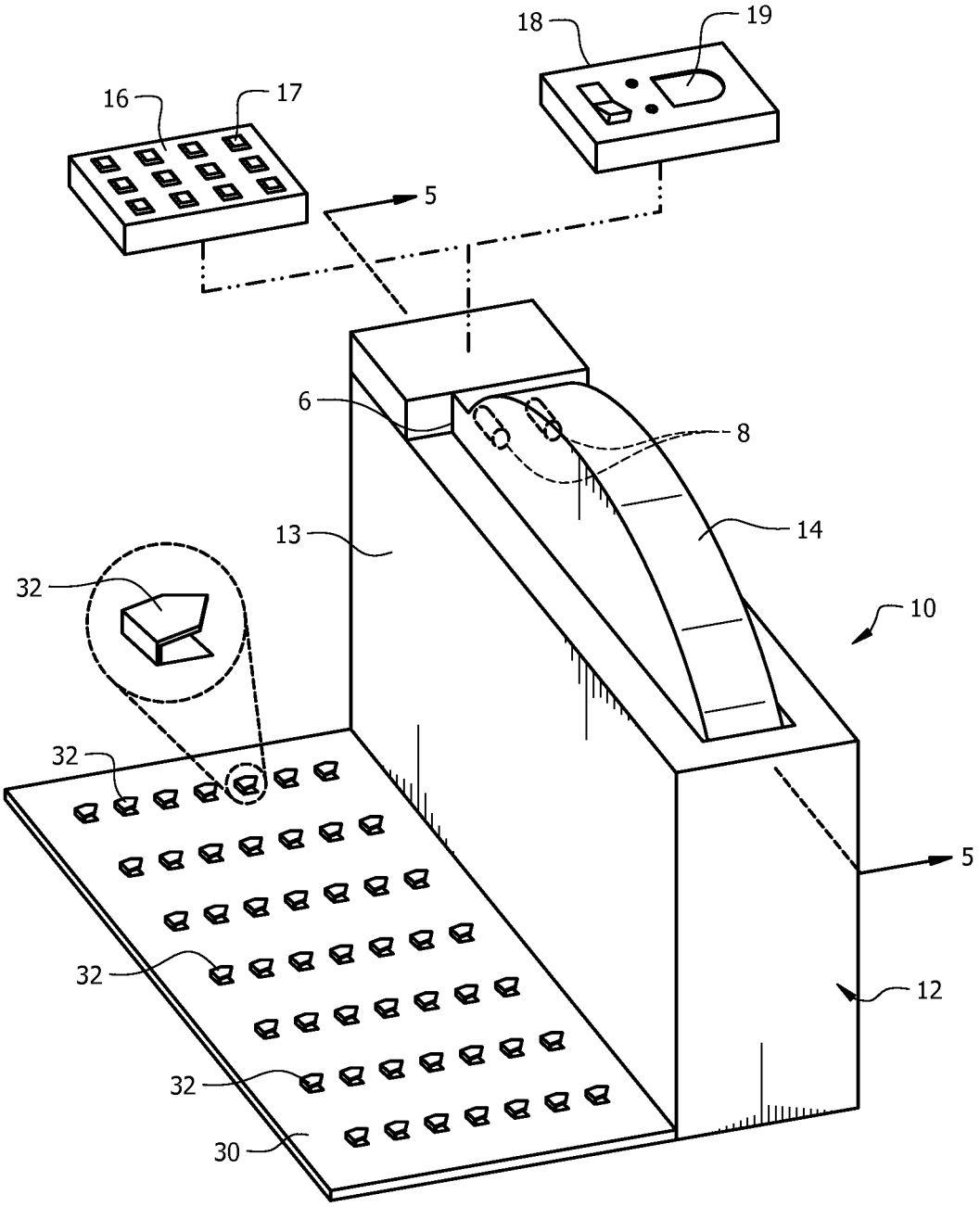
FIG. 1 illustrates a perspective view of a system of a first embodiment in a closed/locked position.

Reference will now be made in detail to the presently preferred embodiments of the invention, examples of which are illustrated in the accompanying drawings. Throughout the following detailed description, the same reference numerals refer to the same elements in all figures. Throughout the description, the term safe is used to represent any such device such as a vault, safe, strong box, gun safe, locked cabinet, locked drawer, etc., that is used to store items and reduce the possibility of loss of the items to theft, fire, etc. The possibility of loss is reduced by making the safe difficult to remove, heavy, sturdy, tamper resistant, affixed to a larger item, affixed to a structure, fire resistant, etc.

Safes, vaults, strong boxes, gun safes, etc. of the prior art generally have a hinged door that swings outwardly and locks when in the closed position. Generally, the door is often almost as wide and high as the actual storage portion of the, e.g., safe. The size of the door requires sufficient space in front of the safe for the door to open wide enough as to access its contents. Furthermore, for some safe systems, the gap between the door and the body or box portion of the safe provides an opening in which a thief is able to pry open some safe doors, reducing security of the safe. In some circumstances, it is imperative to readily and quickly access a content of the safe, for example, to access a ready hand gun when an intruder is present in an individual's home. With conventional safes, once the door is opened, the contents have to be reached for within the safe body. Speed of access, ease of finding the weapon and silence are several important features helpful the survival of the individual under such exemplary circumstances.

Figure 2:
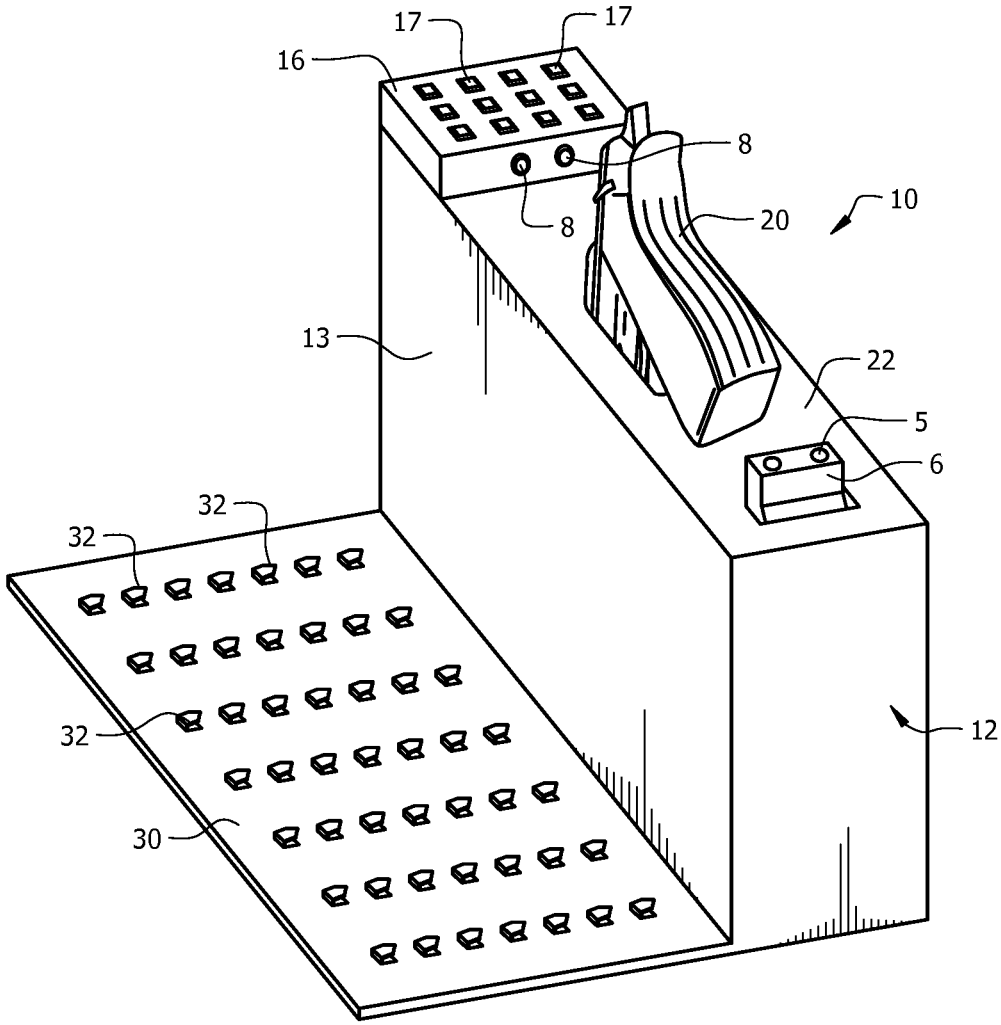
FIG. 2 illustrates a perspective view of the first embodiment in an open position.

To overcome the limitations of existing technology as cited above and others, the safe 10 of FIG. 1 has a rotating door 14 that, after entering the proper code on a combination lock 16 or presenting a known biometric parameter (e.g. fingerprint, voice print) on a biometric sensor 18, the rotating door 14 rotates into an open position as shown in FIG. 2. By operating the rotating door 14, the contents (e.g. gun 20 as in FIG. 2, pepper spray or other weapon) are readily and immediately accessible without undue searching (as required within a cavity of prior safes). As discussed previously, the operation of the rotating door 14 requires minimal clearance with other objects such as headboards, night stands, etc. and, in some embodiments, is noise dampened so as to not alert an intruder of its operation. Furthermore, the sides of the rotating door 14, in some embodiments, extend into the base 12 when the rotating door 14 is closed, thereby reducing risk of a theft or access from prying open the rotating door 14.

The safe 10 has a base 12 that contains the items to be protected such as a gun 20 and an insertion place 30 as will be described later.

Any known locking system is anticipated including a combination lock 16 with a grid or linear set of keys 17, a biometric device 18 such as a finger print scanner 18 with finger print detection pad 19, a key access (not shown), electronic security card (not shown), smart card (not shown), electronic key fob (not shown), etc. All such devices are known in the art and included here within. For example, in one embodiment, the locking system has a sensor that senses the proximity of a key fob (as used with some newer vehicles), and when the key fob is proximal (e.g. on the nightstand, near the safe 10), the lock is energized to open, quickly, with the operation of a simple button or latch, etc.

The locking system 16/18 mechanically operates a locking mechanism such as one or more locking pins 8. When locked, the rotating door 14 is in the closed position and the locking mechanism (e.g. locking pins 8) are extended into mating receptacles 5 of the locking end 6 of the rotating door 14, thereby preventing access to the contents of the safe 10. After the correct code, combination, key, biometric object, etc, is presented to the locking system 16/18, the locking mechanism (e.g. locking pins 8) retract and permit opening of the rotating door 14. In some embodiments, after the locking mechanism (e.g. locking pins 8) retracts, the user pushes on the rotating door 14 to turn it and obtain access to the contents. In a preferred embodiment, the rotating door 14 is spring loaded (see FIG. 5/5A) and, upon retraction of the locking mechanism (e.g. locking pins 8), the loaded spring 52 (see FIG. 5/5A) unloads, automatically opening the rotating door 14. Any type of spring/energy storage mechanism is anticipated including torsion springs, coil springs, opposing same poles of magnets, gas springs, etc.

It is anticipated that the safe 10 be made of any sturdy material such as steel, heavy plastic, wood, aluminum, etc, depending upon the level of security needed. For example, some existing gun racks are made of wood with glass windows. In as such, these gun racks lock to reduce access by youngsters, but a thief with a hammer is able to easily break the glass and takes the guns. It is also anticipated that the safe 10 be made to any size as needed for the weapon, valuables, etc that are to be protected.

In some embodiments, the safe 10 is anticipated to be just large enough to hold a hand gun 20. Since this embodiment and others are relatively small, it is difficult to prevent removal of such a safe 10 since it is not to large nor heavy to carry by most people, including some youngsters. To make it more difficult to remove such embodiments of the safe 10, the safe 10 is coupled to a plate 30 that has barbs 32 on one or both sides. The barbs 32 point in towards the base 12 of the safe 10 such that when inserted between two objects such as a mattress 62 and box spring 64 (see FIG. 3), it is difficult to pull the plate 30 out from between the objects. This provides resistance to being removed by a person who is not capable of lifting the top object (e.g. mattress 62) while disengaging the barbs 32. Performance of such a removal would be impossible for a young child and difficult for some older children and even difficult for many adults. This deters many family members from removing the safe 10 from, for example, between the mattress 62 and bed spring 64, especially since after removal that family member would still be unable to open the rotating door 14. It is even more difficult to remove the safe 10 that is coupled to the plate 30 when located between a bed 60 (see FIG. 3) and a wall (not shown).

Although the plate 30 is shown interfaced or connected to the safe 10, it is anticipated that the plate 30 is used with any other type/style of safe/strong-box such as a safe or strong-box with a typical linear hinge opening arrangement. The plate 30 provides additional security to such devices. In such, the plate 30 is attached, screwed, glued, welded to, or is part of the safe/strong-box.

Figure 3:
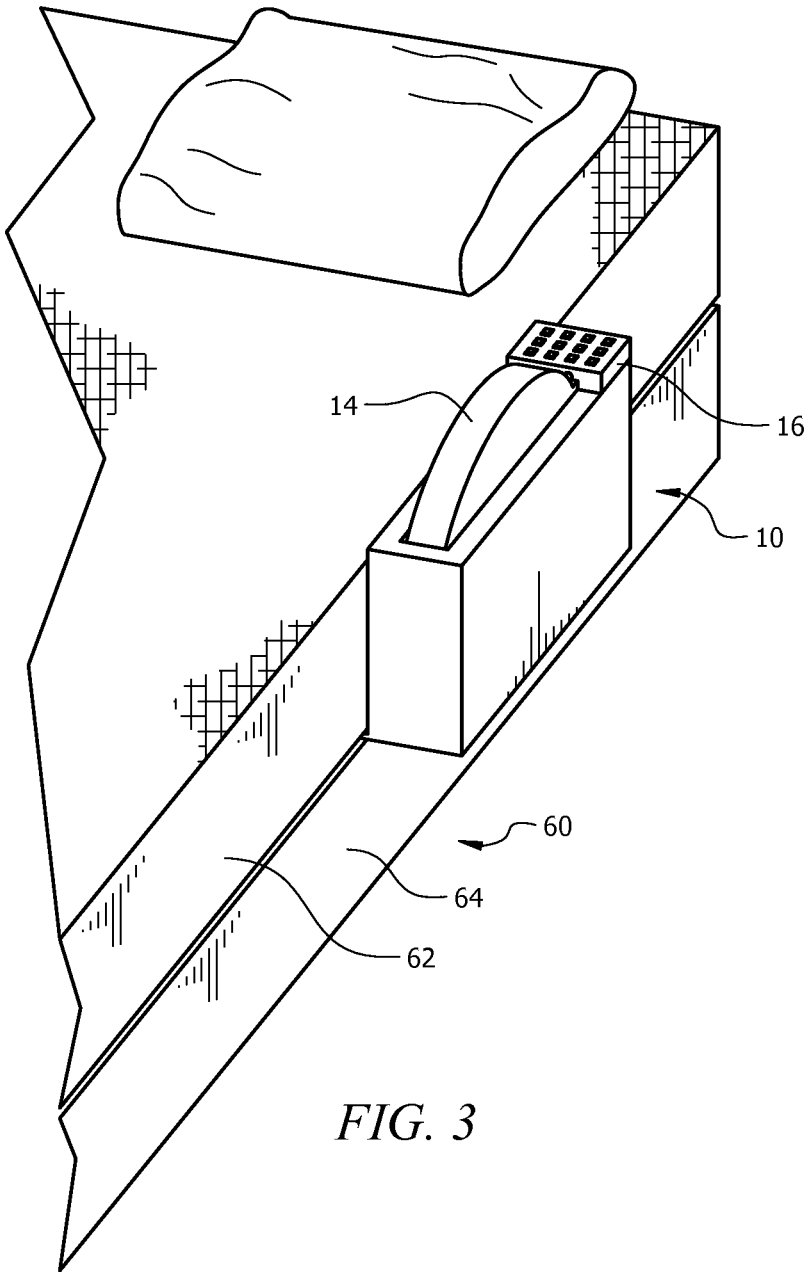
FIG. 3 illustrates a perspective view of a system of a first embodiment interfaced to a bed system in a closed/locked position.

Referring to FIG. 3, a perspective view of a system of the safe 10 interfaced to, for example, a bed system 60 in a closed/locked position is shown. It is anticipated that the safe 10 be interfaced to any suitable object such as the bed system 60 as shown, for example, a night stand, dresser, wall, etc. In the example shown in FIG. 3, the insertion plate 30 (not visible) has been pushed in between the mattress 62 and the box spring 64. Once the plate 30 is inserted between the mattress 62 and the box spring 64, it is difficult to remove by way of the barbs 32 that point towards the safe 10. If one tries to pull the plate 30 out from between the mattress 62 and the box spring 64, the barbs 32 dig into the mattress 62 and/or the box spring 64, making it difficult or impossible to remove by the ordinary person. Remove is accomplished by lifting the mattress 62 and disengaging the barbs 32 from the mattress 62 and/or the box spring 64. Most mattresses 62 are heavy and difficult for many single adults to lift, let alone hold suspended above the box spring 64 while working to disengage the barbs 32. The plate 30/barb 32 holding mechanism as shown is anticipated to deter most younger members of a household from removing the safe 10, even though once they removed the safe 10 from the bed system 60, it is difficult to gain access to the safe 10 without the key, combination, code, biometric match, etc. Of course, a seasoned thief will be able to remove the safe 10 from the bed system 60, but most conceivable mounting mechanisms of any safe to a bed system 60 are able to be defeated by a thief having the appropriate tools.

Figure 4:
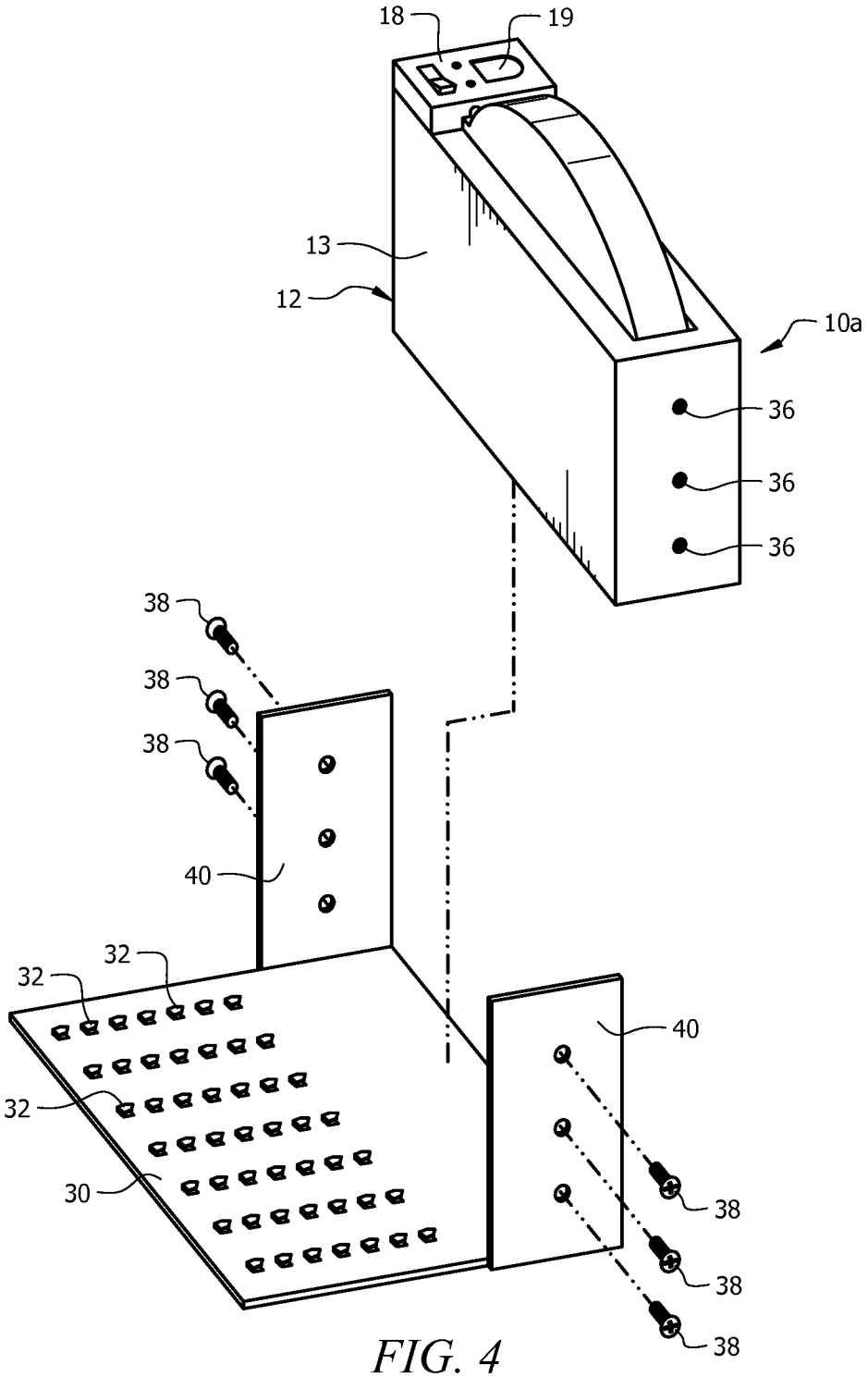
FIG. 4 illustrates a perspective view of a system of a second embodiment interfaced to a detachable/adjustable bed interface system.

Referring to FIG. 4, a perspective view of a system of a second embodiment interfaced to a detachable/adjustable plate is shown. It is anticipated that the safe 10 of the present invention be used with or without the plate 30 and barbs 32. For example, in some uses, the safe 10, without the plate 30 and barbs 32, is screwed into a heavy, large object such as a bed frame (not shown) a dresser (not shown), etc.

Furthermore, because some mattresses 62 (see FIG. 3) are thicker than other mattresses 62 and it is desired to have the safe 10 open with ready access to the handle of the gun 20 or other weapon, for thicker mattresses 62, the safe 10 is desired to be higher with respect to the bottom of the mattress 62. To this means, the embodiment shown in FIG. 4 includes a plate 30 with barbs 32 on one side or both sides of the plate 30. The plate 30 has mounting brackets 40 on one or both sides for affixing the plate 30 to the safe 10 in any way known in the industry such as using screws 38 that pass through the brackets 40, through walls of the safe 10 and are bolted from within the safe 10, preferably with tamper resistant screws/bolts (e.g., locked with a cotter pin or the like). In this way, the safe 10 is capable of being positioned higher with respect to the plate 30 by using only the top two holes in the brackets 40 and the lower two holes in the wall of the safe 10, etc. It is anticipated that any number of holes, slots, screws, fasteners etc are used for various mounting configurations. Furthermore, other mechanisms are known in the industry for mounting objects to each other, all of which are included here within.

In some embodiments, the safe 10 is affixed to the plate 30 and is removable from the plate 30 or other device after the door 14 is opened or by an external lock, for example, a pad lock. In such, the safe 10 is secured to an object such as the bed system 60 and, when traveling, is removed from the object or plate 30 and taken by the owner, for example, into a vehicle. In such, it is anticipated that the safe 10 be carried in the vehicle and optionally, mounted/locked to the vehicle for added theft deterrence.

Figure 5A:
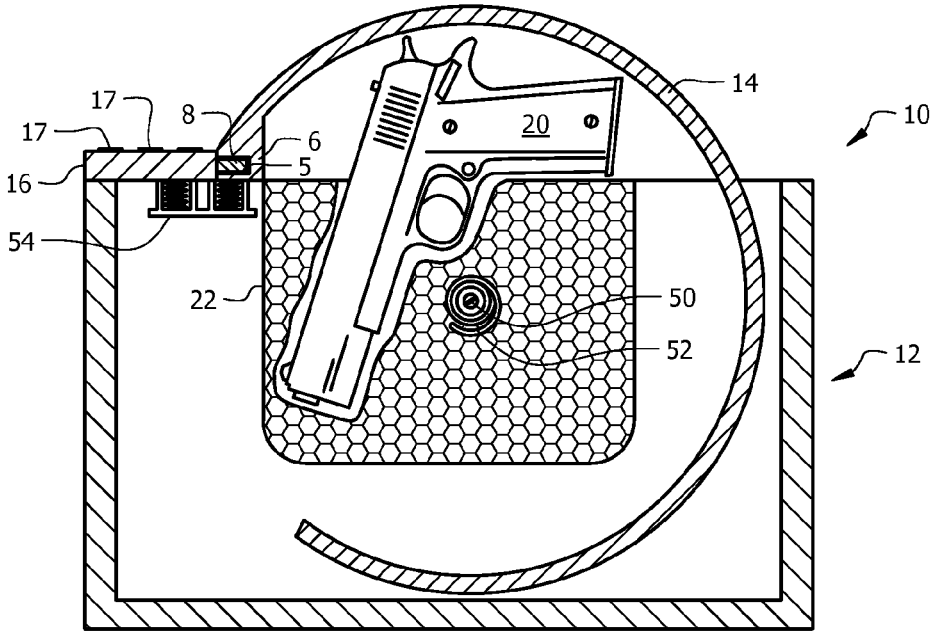
FIG. 5A illustrates a sectional view of all embodiments in a closed/locked position.
Figure 5B:
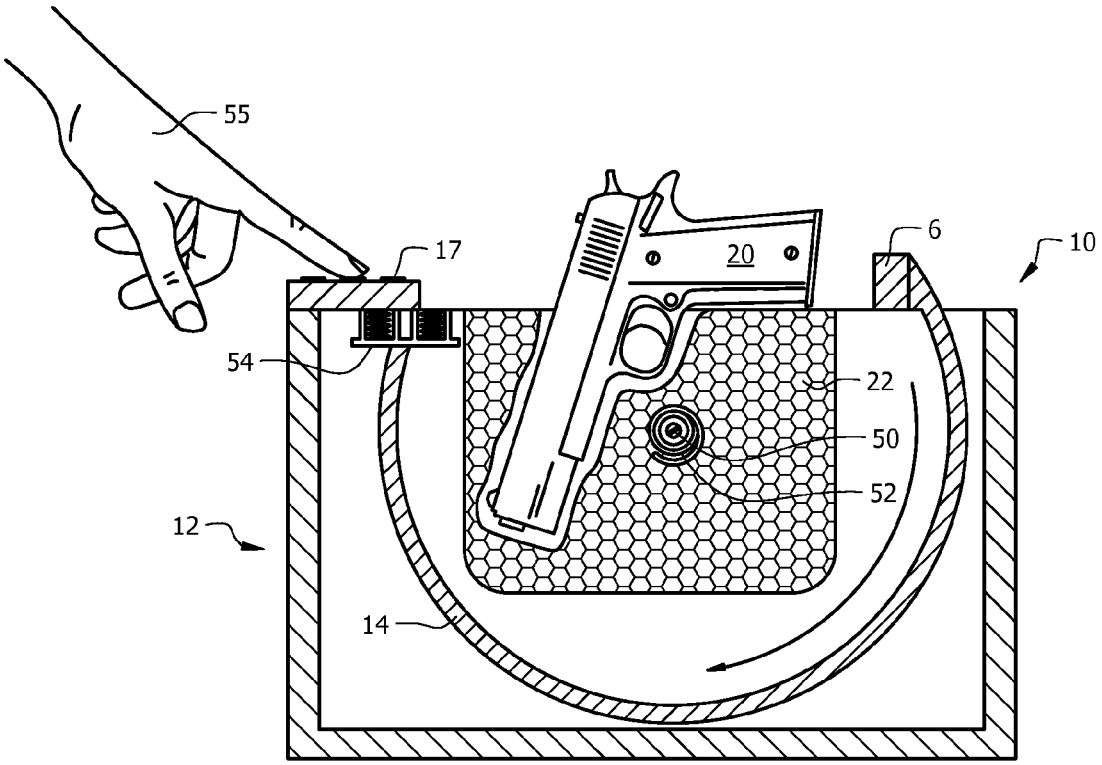
FIG. 5B illustrates a sectional view of all embodiments in an open position.

Referring to FIGS. 5A and 5B, a sectional view of all embodiments in a closed/locked position (FIG. 5A) and in an open position (FIG. 5B) are shown. In this view it is shown how the rotating door 14 rotates into the open position providing access to the contents of the safe 10, in this example, providing access to the handle end of a gun 20.

In FIG. 5A, the safe 10 is in the closed position and access to the gun 20 is denied. In FIG. 5B, an authorized user 55 has, for example, pressed the correct sequence of buttons 17 on the combination lock 16 and the door 14 has automatically rotated to the open position.

In a preferred embodiment, the gun 20 or other weapon is supported in a form fitted material 22 such as foam rubber, Styrofoam, etc. In this way, the gun 20 or other weapon is held in a ready-to-use position for fast access during an emergency such as a home intrusion. This position provides additional safety from inadvertent firing of some weapons being that the gun 20 faces down when the, possibly frantic, owner reaches for the gun 20.

In some embodiments, replaceable/interchangeable form fitted material 22 is provided with different opening formations to hold different sizes of guns 20 or other weapons. For example, in one embodiment, the form fitted material 22 has a cylindrical cavity sized to hold a can of pepper spray (not shown) while in other embodiments, the form fitted material 22 is cut to the shape of the gun 20 or other weapon and/or has sections that are easily removed to increase the size of the form opening, thereby holding larger guns 20 or other weapons.

In a preferred embodiment, the rotating door 14 is supported by a bearing 50 and the bearing is affixed to a surface of the side walls 13 of the base 12. Many arrangements of axles, partial axles, side stubs, etc. are known, all of which are included here within. In other embodiments, the rotating door 14 is rotatably interfaced to the base 12 in any of many known ways including various types of bearings and rotating interfaces. Still in other embodiments, the rotating door 14 is supported by (held within) a sleeve (not shown) on one side or both sides of the rotating door 14 within the base 12.

In some embodiments, the rotating door 14 is spring loaded by, for example, a coil spring 52. In this example, one end of the coil spring 52 is interfaced to the base 12 and the other end of the coil spring 52 is interfaced to the rotating door 14 so that when the rotating door 14 is closed (locked) as in FIG. 5A, the coil spring 52 is tensioned and when the rotating door 14 is later released (unlocked), the coil spring 52 uncoils and pushes the rotating door 14 to the open position as in FIG. 5B.

Because the safe 10 is often used in a situation where it is important that little or no audible noise is made during access, in some embodiments, dampers 54 softly stop the rotation of the rotating door 14. The dampers 54 are designed to slowly stop the rotating door 14 when it approaches the full open position. In some embodiments, the dampers 54 are soft; cushion material such as rubber, resilient foam, etc. In some embodiments, the dampers 54 include springs or spring assemblies. In some embodiments, the dampers 54 are combinations of resilient material, springs or any other known damping mechanism.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A safe comprising:

a safe body, the safe body having an opening;

a door rotatably interfaced to the safe body, such that the door obstructs the opening in a first position of rotation and the door provides access to the safe through the opening in a second position of rotation, whereas the door rotates to be at least partially contained within the safe body in the second position of rotation;

an energy storage mechanism interfaced between the safe body and the door; and a locking mechanism affixed to the safe body, the locking mechanism engages between the door and the safe body when the door is in the first position of rotation, energy is stored in the energy storing mechanism when the door is rotated into the first position of rotation and, upon enabling access by the locking mechanism, the locking mechanism disengages between the door from the safe body, and the energy storing mechanism releases the energy causing the door to rotate towards the second position of rotation.

2. The safe of claim 1, wherein the enabling access by the locking mechanism is performed by entering a combination.

3. The safe of claim 1, wherein the enabling access by the locking mechanism is performed by presenting a biological sample.

4. The safe of claim 1, wherein the energy storage mechanism is a spring.

5. The safe of claim 1, further comprising a plate affixed to the safe body, the plate having a plurality of barbs formed on at least one surface of the plate, the barbs pointing towards the safe body, such that it is easier to push the plate between two objects than it is to pull the plate out from between the two objects, whereas after being slid between a mattress and a box spring, the barbs dig into the mattress, thereby preventing removal of the plate from between the mattress and the box spring.

6. The safe of claim 1, further comprising one or more formed inserts within the safe body, the formed inserts supporting an object in a position such that the object is ready for access when the door of the safe is in the second position.

7. The safe of claim 6, wherein the object is a weapon selected from the group consisting of a gun, a knife and pepper spray.

8. A method of providing quick access to a protected weapon, the method comprising:

providing a safe, the safe comprising:

a body portion having an opening;

a door rotatably interfaced to the body portion, the door is shaped as a partial cylinder such that the door restricts access to the opening in a first position of rotation and the door provides access to the safe through the opening in a second position of rotation; and a locking mechanism interfaced between the body portion and the door, the locking mechanism engages the door and the body portion when the door is in the first position of rotation and, upon enabling access by the locking mechanism, the locking mechanism disengages with the door, allowing the door to rotate into the second position of rotation;

an energy storing mechanism interfaced between the door and the body portion;

placing a weapon within the body portion of the safe;

closing and locking the door, thereby storing energy in the energy storing mechanism;

providing a key to the locking system, the locking system releasing the locking mechanism responsive to the key; and the energy from the energy storing mechanism rotating the door towards the second position responsive to the releasing of the locking mechanism, thereby providing access to the weapon.

9. The method of claim 8, wherein the key is a combination.

10. The method of claim 8, wherein the key is a fingerprint.

11. The method of claim 8, further comprising:

replacing the weapon within the body portion of the safe;

reclosing and relocking the door, thereby storing energy in the energy storing mechanism.

12. The method of claim 8, wherein the weapon is selected from the group consisting of a gun, a knife and pepper spray.

13. A safe comprising:

a body for holding an object, the body having an opening;

a door rotatably interfaced to the body, whereas the door obstructs the opening in a first position of rotation, and the door provides access to the body of the safe through the opening when the door is in a second position of rotation; and a locking mechanism, the locking mechanism engages between the door and the body when the door is rotated to the first position of rotation thereby holding the door in the first position of rotation until the locking mechanism is released and, upon releasing by the locking mechanism, the door is free to rotate towards the second position of rotation;

whereas the door rotates to be at least partially contained within the safe body in the second position of rotation.

14. The safe of claim 13, wherein the key a combination.

15. The safe of claim 13, wherein the key is a fingerprint.

16. The safe of claim 13, wherein the key is a wireless key fob.

17. The safe of claim 13, further comprising an energy storing mechanism interfaced between the body and the door, such that, moving the door from the second position to the first position stores energy in the energy storing mechanism and releasing the door while the door is in the first position releases the energy from the energy storing mechanism, thereby urging the door towards the second position.

18. The safe of claim 17, wherein the energy storing mechanism is a spring.

19. The safe of claim 18, wherein the spring is a torsion spring.

20. The safe of claim 17, wherein the energy storing mechanism is a pair of magnets configured to have like poles approach each other in the first position, thereby repelling each other to urge the door into the second position when the locking mechanism is released.

* * * * *